US005365950A

United States Patent [19]

Yoshimoto et al.

[11] Patent Number: 5,365,950

[45] Date of Patent: Nov. 22, 1994

[54] EXPANDING APPARATUS FOR AGRICULTURAL PRODUCT OR THE LIKE

[75] Inventors: Kazuo Yoshimoto; Takashi Ogawa; Hiromi Uematsu; Manabu Takeuchi; Kensuke Uchiyama, all of Hiratsuka, Japan

[73] Assignee: Japan Tobacco Inc., Tokyo, Japan

[21] Appl. No.: 193,878

[22] Filed: Feb. 9, 1994

Related U.S. Application Data

[63] Continuation of Ser. No. 885,439, May 20, 1992, abandoned.

[30] Foreign Application Priority Data

May 20, 1991 [JP] Japan ..... 3-145556
May 20, 1991 [JP] Japan ..... 3-145557
May 20, 1991 [JP] Japan ..... 3-145562

[51] Int. Cl.[5] ..... A24B 3/18

[52] U.S. Cl. ..... 131/291; 131/296; 131/900; 131/901

[58] Field of Search ..... 131/290, 291, 292, 296, 131/900–902; 55/16, 25

[56] References Cited

U.S. PATENT DOCUMENTS

Re. 32,014 10/1985 Sykes et al. .
3,575,178 4/1971 Stewart ..... 131/296
3,957,463 5/1976 Drissel et al. ..... 55/25
4,165,618 8/1979 Tyree ..... 131/900 X
4,253,474 3/1981 Hibbitts et al. .
4,258,729 3/1981 de La Burde et al. .
4,310,006 1/1982 Hibbitts et al. .
4,333,483 6/1982 de La Burde et al. .
4,791,942 12/1988 Rickett et al. .
5,020,550 6/1991 Uchiyama et al. .
5,076,293 12/1991 Kramer .

FOREIGN PATENT DOCUMENTS 0328676 2/1989 European Pat. Off. .

*Primary Examiner*—Jennifer Bahr

[57] ABSTRACT

An expanding apparatus supplies an expanding agent to an impregnating vessel, and continuously supplies and discharges a material, e.g., a tobacco material to and from the impregnating vessel through a valve while pressure-increasing or pressure-decreasing the material, thereby continuously expanding the material. The expanding agent supplied to the impregnating vessel, the valve, and the like is recovered and, air, an impurity gas, or the like mixed in it is removed. Thereafter the expanding agent is pressure-increased to a high pressure and supplied to the impregnating vessel and the valve again.

3 Claims, 11 Drawing Sheets

EXPANDING APPARATUS FOR AGRICULTURAL PRODUCT OR THE LIKE

This application is a continuation, of application Ser. No. 07/885,439 filed on May 20, 1992, now abandoned.

BACKGROUND OF THE INVENTION

1. Field of the Invention

The present invention relates to an improvement in an expanding apparatus for expanding an agricultural product such as a tobacco material or food. More particularly, the present invention relates to an expanding apparatus using carbon dioxide as an expanding agent, which can expand the tobacco material or the like continuously and can recycle the expanding agent in the system without discharging it to the outside.

2. Description of the Related Art

Conventionally, when a cigarette is to be manufactured from the tobacco material, i.e., the shredded tobacco leaf, the tissues of the tobacco material are expanded.

To expand the tobacco material, a gaseous or liquid expanding agent, i.e., an organic solvent, carbon dioxide, or the like is liquefied or pressurized to a high pressure, the tobacco material is held in the expanding agent to impregnate the tobacco tissues with the expanding agent, and the tobacco tissues are pressure-decreased and then heated to expand the impregnated expanding agent, thereby expanding the tissues of the tobacco material. When the tobacco material is expanded in this manner, its volume is increased to decrease the amount of tobacco material necessary for manufacturing a cigarette, and to provide a light smoking taste. The tobacco material expanded in this manner is used to manufacture a cigarette directly or by being mixed with a non-expanded tobacco material.

The expanding apparatuses for performing this expanding process are classified into batch type expanding apparatuses and continuous type expanding apparatuses. In a batch type expanding apparatus, a predetermined amount of tobacco material is stored in an impregnating vessel, a high-pressure expanding agent is supplied to the impregnating vessel to impregnate the tobacco material with the expanding agent, and thereafter the tobacco material is removed, thereby expanding the tobacco material. In a continuous type expanding apparatus, the tobacco material is continuously supplied in an impregnating vessel to which a high-pressure expanding agent is supplied to impregnate the tobacco material with the expanding agent, and the tobacco material impregnated with the expanding agent is continuously removed.

Although the former batch type apparatus has a simple structure, its efficiency is low and a large amount of expanding agent is unpreferably lost in the outer air. The latter continuous type apparatus is efficient and can recover and re-utilize the expanding agent without any waste. The continuous type apparatus, however, requires valve units for continuously supplying the tobacco material in the impregnating vessel while increasing the pressure in the impregnating vessel and for removing the tobacco material while decreasing the pressure in the impregnating vessel. Since air is mixed in the impregnating vessel through the valve units to degrade the expanding efficiency, the expanding agent discharged through the valve units must be recovered.

Recently, carbon dioxide which rarely adversely affects the environment has been used as the expanding agent. However, the operation must be performed at a high pressure in order to impregnate carbon dioxide, requiring that the valve units described above have higher performance.

The size of such an expanding apparatus has been increasing so as to increase the amount of carbon dioxide used in it. Accordingly, in order to prevent an adverse influence on the environment and to decrease the carbon dioxide consumption, carbon dioxide recovery must be maximized as much as possible to decrease the amount discharged to the outside and to efficiently remove air mixed in the impregnating vessel.

Carbon dioxide used for expanding the tobacco material is compressed and used again, as described above. However, since compression of carbon dioxide needs energy, further energy conservation is required. Furthermore, since air is mixed in circulating carbon dioxide, a large facility and energy are required to separate the mixed air. Accordingly, the amount of air mixed in circulating carbon dioxide must be decreased as much as possible.

The expanding apparatus can be used not only as an apparatus for expanding the tobacco material as described above but also as an apparatus, used for drying an agricultural product, e.g., a vegetable, which expands the vegetable to manufacture a dry vegetable which can be cooked easily.

SUMMARY OF THE INVENTION

It is an object of the present invention, in an apparatus for expanding an agricultural product, e.g., a tobacco material by using an expanding agent, e.g., carbon dioxide which satisfies the demands described above, to enable continuous expansion of the tobacco material, to prevent air from mixing in carbon dioxide as much as possible, to efficiently remove the mixed air, and to minimize the energy required for operating the expanding apparatus.

In order to achieve the above object, an expanding apparatus according to the present invention comprises an impregnating vessel to which an expanding agent, e.g., carbon dioxide pressure-increased to a high pressure, is supplied. The tobacco material is continuously supplied to the impregnating vessel through the rotary valves. The tobacco material impregnated with carbon dioxide in the impregnating vessel is continuously removed through the rotary valves, carbon dioxide impregnated in the tobacco material in a low-pressure, high-temperature atmosphere is expanded, and the tissues of the tobacco material are expanded.

The rotary valves continuously feed the tobacco material while increasing or decreasing the pressure of the atmospheric gas of the tobacco material, e.g., carbon dioxide. For example, two rotary valves are disposed in series on each of the pressure-increase and pressure-decrease sides. When the pressure in the impregnating vessel is, e.g., 30 atm, the atmospheric gas of the tobacco material is pressure-increased or pressure-decreased 15 atm by each rotary valve.

According to the first aspect indicated in this specification, carbon dioxide supplied to the impregnating vessel and the rotary valves is recovered and used again. Air flowing from the outside is mixed in the recovered carbon dioxide, and the mixed air is separated and removed. Accordingly, the concentration of air in carbon dioxide circulating in this apparatus is maintained within a range not to decrease the expansion efficiency.

A PSA (Pressure Swing Absorption) apparatus is used as a unit for separating air from the recovered carbon dioxide. This unit uses an adsorbent, e.g., activated charcoal or zeolite whose adsorption amount of carbon dioxide is changed by changing the pressure. The adsorbent selectively adsorbs carbon dioxide, for example, a gas mixture is supplied with a pressure of about 2 atm, and mixed air is separated. When the pressure is decreased to almost a vacuum state, adsorbed carbon dioxide is desorbed and recovered. Alternately, this operation can be efficiently performed by using a plurality of adsorption towers.

According to the second aspect of the present invention, a hermetic vessel is provided upstream of the pressure increase-side rotary valve, and the tobacco material is supplied to the rotary valve through the hermetic vessel. Another hermetic vessel is also provided downstream of the pressure decrease-side rotary valve, and the tobacco material discharged from the pressure decrease-side rotary valve is fed to an expansion step through this hermetic vessel. Carbon dioxide is supplied to these hermetic vessels, and air in the hermetic vessels is substituted with carbon dioxide. Therefore, air is prevented from mixing in the carbon dioxide circulating system of, e.g., the impregnating vessel by these rotary valves.

According to the third aspect of the present invention, since the two rotary valves are provided on each of the pressure-increase and pressure-decrease sides, carbon dioxide passing through the rotary valve closer to the impregnating vessel is at an intermediate pressure, and carbon dioxide discharged through the rotary valve farther away from the impregnating vessel is at a low pressure. The intermediate-pressure carbon dioxide and the low-pressure carbon dioxide are recovered by separate recovery systems, pressure-increased to a high pressure by separate boosters or the like, and returned to the impregnating vessel. Accordingly, the energy required for pressure-increasing the recovered carbon dioxide can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The preferred embodiments of the present invention will be described with reference to the accompanying drawings. These embodiments exemplify continuous type tobacco material expanding apparatuses using carbon dioxide as the expanding agent. FIGS. 1 to 6 show the first embodiment of the present invention.

Figure 1:
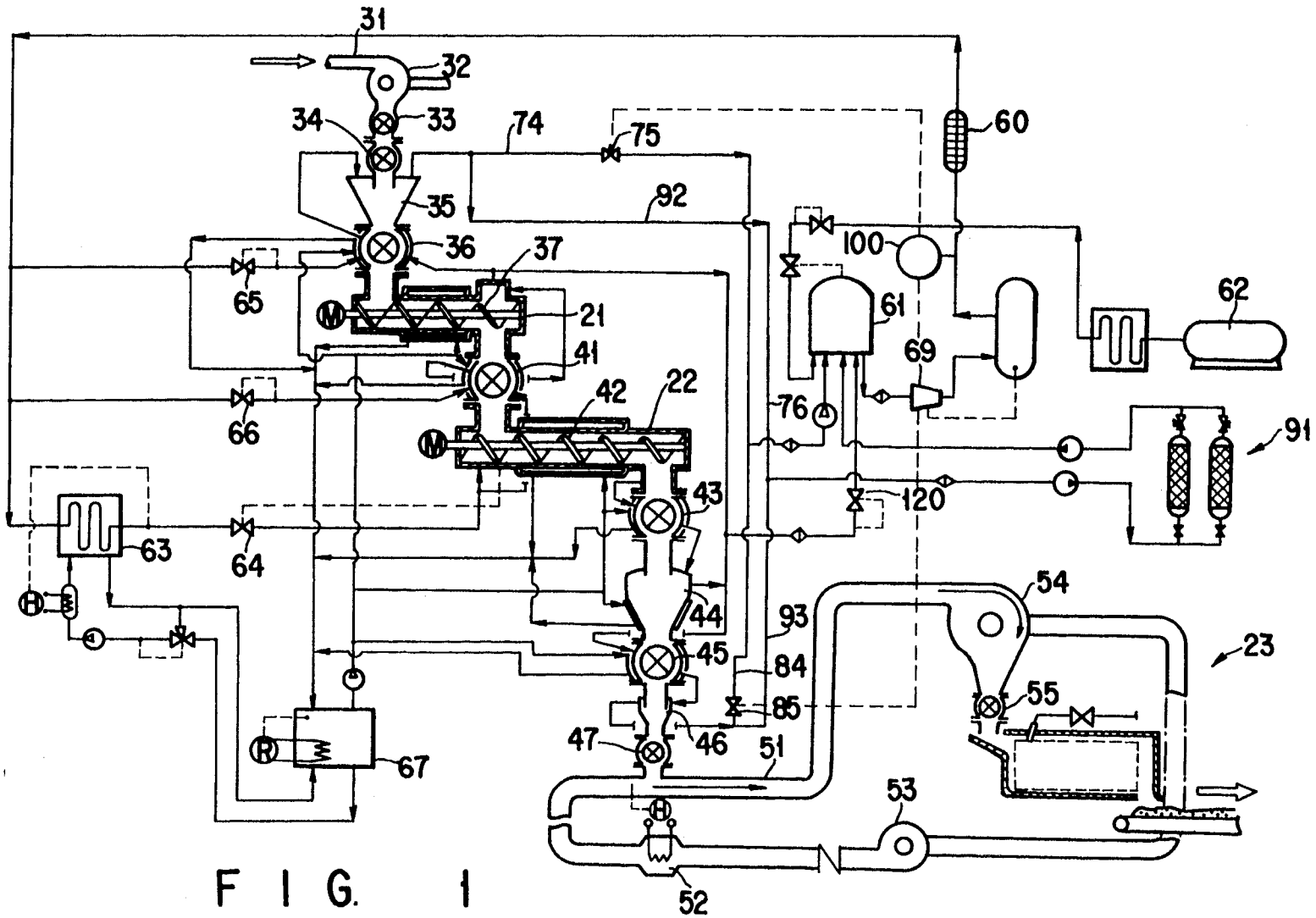
FIG. 1 is a schematic diagram showing an overall arrangement of an expanding apparatus according to the first embodiment of the present invention.

The outline of this expanding apparatus will be described. FIG. 1 schematically shows the entire arrangement of the tobacco material expanding apparatus. Referring to FIG. 1, reference numeral 21 denotes a preparatory impregnating vessel; and 22, an impregnating vessel. Carbon dioxide having a predetermined pressure is held in the preparatory impregnating vessel 21 at a pressure of about 15 atm. Carbon dioxide is supplied to the impregnating vessel 22 to maintain a pressure of about 30 atm, and the interior of the impregnating vessel 22 is substantially filled with gaseous carbon dioxide.

The tobacco material is continuously supplied to the preparatory impregnating vessel 21, and is then continuously supplied from the preparatory impregnating vessel 21 to the impregnating vessel 22. The tissues of the tobacco material are impregnated with carbon dioxide in the impregnating vessel 22.

The tobacco material impregnated with carbon dioxide is continuously supplied to a heating unit 23 to contact superheated water vapor in the heating unit 23. Then, carbon dioxide impregnated in the tobacco material is expanded, thereby expanding the tissues of the tobacco material.

The respective portions of the expanding apparatus will be described. The tobacco material is transported in a transport pipe 31 together with air. The tobacco material is separated from air by a tangential separator 32 and supplied to a hermetic vessel 35 to be described later through air locker valves 33 and 34. The pressure in the hermetic vessel is substantially an atmospheric pressure.

The tobacco material supplied to the hermetic vessel 35 is continuously supplied to the preparatory impregnating vessel 21 through a pressure increase-side first rotary valve 36. While the tobacco material is supplied through the first rotary valve 36, its atmosphere is pressure-increased from the substantial atmospheric pressure to about 15 atm of the preparatory impregnating vessel 21. A screw 37 is provided in the preparatory impregnating vessel 21 to feed the tobacco material.

The tobacco material from the preparatory impregnating vessel 21 is then supplied to the impregnating vessel 22 through a pressure increase-side second rotary valve 41. While the tobacco material is supplied through the second rotary valve 41, its atmosphere is pressure-increased from 15 atm of the preparatory impregnating vessel 21 to 30 atm of the impregnating vessel 22.

The tobacco material supplied to the impregnating vessel 22 is then fed by a screw 42 provided in the impregnating vessel 22. Carbon dioxide is supplied to the impregnating vessel 22 to maintain a high pressure of about 30 atm, and the tissues of the tobacco material are impregnated with carbon dioxide.

The tobacco material discharged from the impregnating vessel 22 is supplied to a hermetic vessel 44 through a pressure decrease-side third rotary valve 43. The interior of the hermetic vessel 44 is kept in a carbon dioxide atmosphere having a pressure of about 15 atm. While the tobacco material passes through the third rotary valve 43, its ambient gas is pressure-decreased from 30 atm of the impregnating vessel 22 to 15 atm of the hermetic vessel 44.

Furthermore, the tobacco material discharged from the hermetic vessel 44 is supplied to a hermetic vessel 46 through a pressure decrease-side fourth rotary valve 45. The interior of the hermetic vessel 46 is kept in a carbon dioxide atmosphere having substantially atmospheric pressure. While the tobacco material passes through the fourth rotary valve 45, its pressure is decreased from 15 atm of the hermetic vessel 44 to about the atmospheric pressure of the hermetic vessel 46.

The tobacco material supplied to the hermetic vessel 46 is continuously supplied to an expansion column 51 of the heating unit described above through an air locker valve 47. A gas mixture of air and a superheated water vapor flows through the expansion column 51. The gas mixture is heated to a predetermined temperature by a heater 52 and is fed in the expansion column 51 by a fan 53. The tobacco material supplied to the expansion column 51 contacts the gas mixture to be heated. Then, carbon dioxide impregnated in the tobacco material is expanded, thereby expanding the tissues of the tobacco material. The expanded tobacco material is separated by a tangential separator 54 and discharged through an air locker valve 55. The air locker valve 47 serves to prevent the gas in the expansion column 51 from flowing into the hermetic vessel 46.

Figure 2:
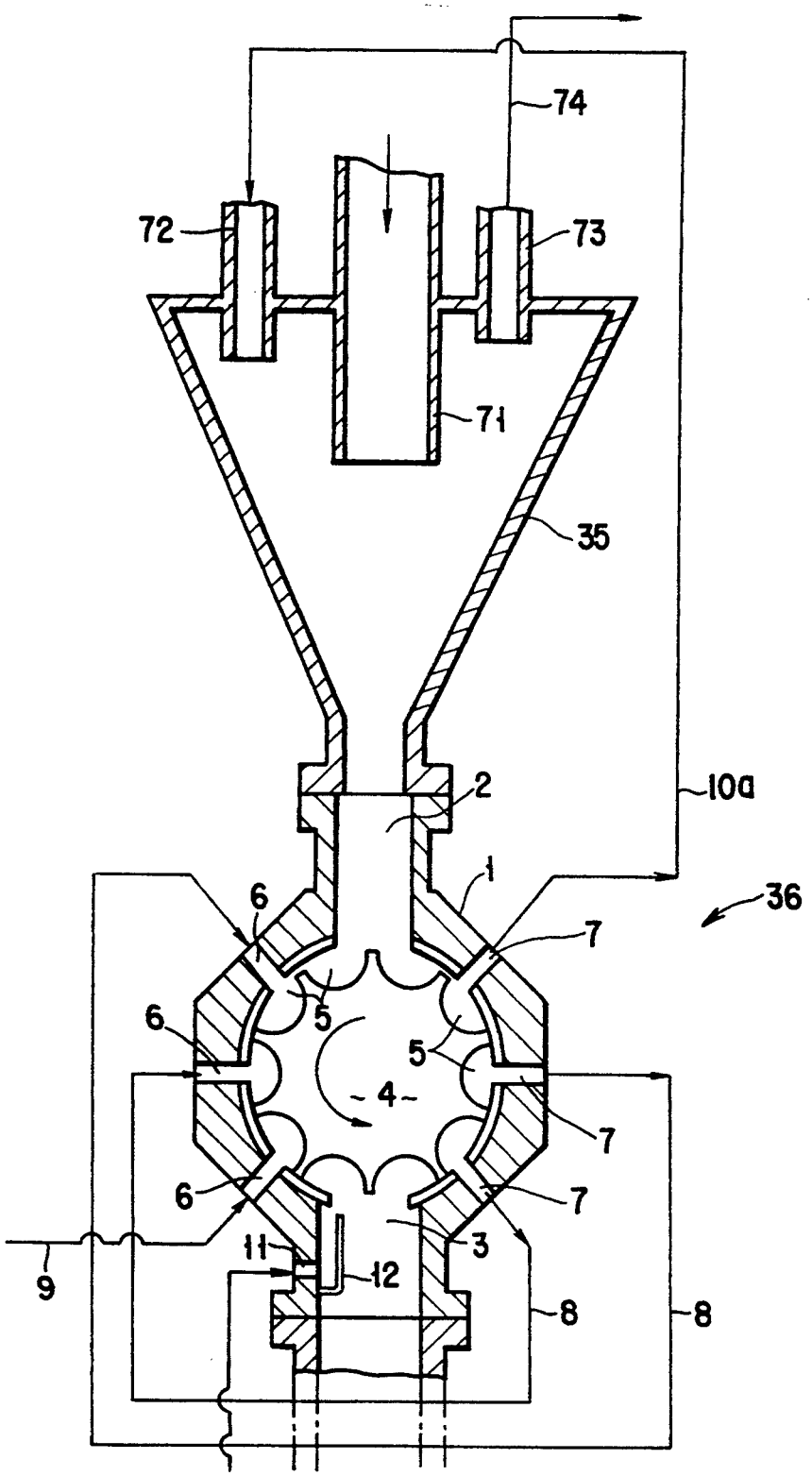
FIG. 2 is a longitudinal sectional view of a first rotary valve and a hermetic vessel.

The first to fourth rotary valves 36, 41, 43, and 45 have substantially the same arrangement. FIG. 2 shows the structure of, e.g., the first rotary valve 36. Referring to FIG. 2, reference numeral 1 denotes a housing of the rotary valve 36. Supply and discharge ports 2 and 3 are formed in the housing 1. A rotating member 4 is rotatably, hermetically housed in the housing 1. A plurality of pockets 5 are formed on the outer surface of the rotating member 4. A plurality of pressure increase- and decrease-side ports 6 and 7 are formed in the housing 1. The final-stage high-pressure port among the pressure increase-side ports 6 is connected to the preparatory impregnating vessel 21 through a carbon dioxide supply pipe 9 so that high-pressure carbon dioxide is supplied to it. The last low-pressure port among the pressure decrease-side ports 7 is connected to a carbon dioxide recovery pipe 10*a* so that pressure decreased carbon dioxide is recovered. The remaining pressure increase- and decrease-side ports 6 and 7 communicate with each other through corresponding communication pipes 8.

The inside of the supply port 2 is set at, e.g., an atmospheric pressure, and the inside of the discharge port 3 is set in an intermediate-pressure carbon dioxide atmosphere. The tobacco material charged into the supply port 2 through a hopper or the like is stored in the respective pockets 5 of the rotating member 4 and sequentially transported to the discharge port 3 as the rotating member 4 rotates.

Since the inside of the discharge port 3 is set in an intermediate-pressure carbon dioxide atmosphere, the interior of an empty pocket 5 which has opposed the discharge port 3 to discharge the tobacco material in it is set in the intermediate-pressure carbon dioxide atmosphere. While the pockets 5 sequentially oppose the pressure decrease-side ports 7, high-pressure carbon dioxide in each pocket 5 is sequentially discharged to the opposite pressure decrease-side port 7 to be pressure-decreased, e.g., about every 5 atm. Since the pressure decrease-side ports 7 communicate with the pressure increase-side ports 6 through the communication pipes 8, carbon dioxide discharged from the respective pressure decrease-side ports 7 is supplied to the corresponding pressure increase-side ports 6. Accordingly, while each pocket 5 storing the tobacco material sequentially opposes each pressure increase-side port 6, carbon dioxide in this pocket 5 is pressure-increased, e.g., every 5 atm. When each pocket 5 opposes the final-stage pressure increase-side port 6, carbon dioxide in this pocket 5 is pressure-increased to the same pressure as that of the inside of the discharge port 3. Then, this pocket 5 opposes the discharge port 3 to discharge the tobacco material stored in it through the discharge port 3.

When the empty pocket 5 opposes the final-stage pressure decrease-side port 7, low-pressure carbon dioxide remaining in the pocket 5 is recovered from the pressure decrease-side port 7 through the carbon dioxide recovery pipe 10*a*, and the interior of the pocket 5 is restored to the atmospheric pressure.

A nozzle wall 12 is provided in the discharge port 3, and an injection port 11 is formed to communicate with the gap between the nozzle wall 12 and the inner surface of the discharge port 3. High-pressure carbon dioxide is supplied through the injection port 11 to inject high-pressure carbon dioxide from the gap defined by the nozzle wall 12 and the inner surface of the discharge port 3 into the empty pocket 5 from which the tobacco material has been discharged, thereby removing the tobacco material remaining in the pocket 5 by the injection flow.

The above description exemplifies a pressure increase-side rotary valve for continuously supplying the tobacco material while increasing its pressure. However, the pressure decrease-side rotary valves for discharging the tobacco material while decreasing its pressure have the same structure as described above and perform pressure increase and decrease operations in the opposite manner.

Figure 3:
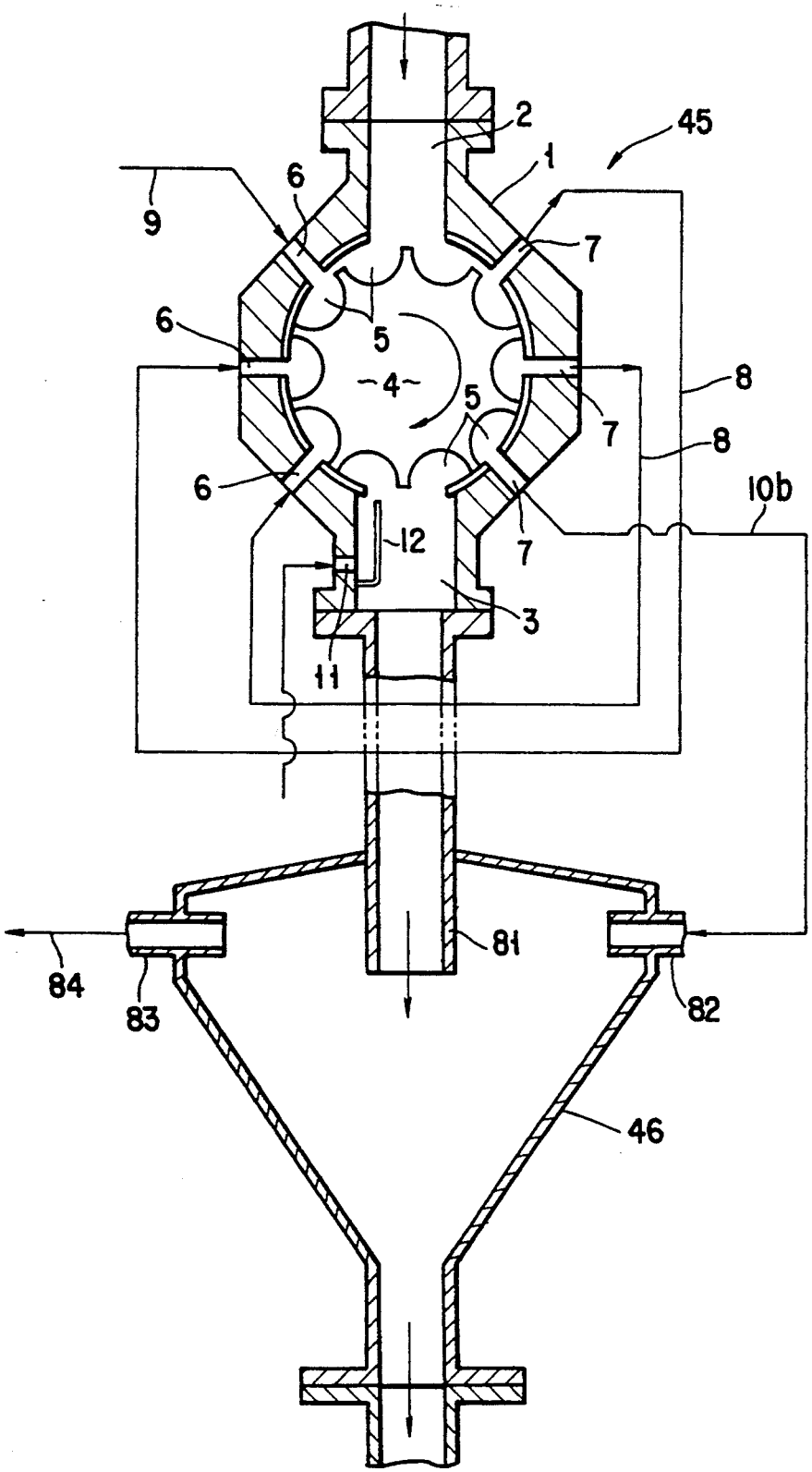
FIG. 3 is a longitudinal sectional view of a fourth rotary valve and a hermetic vessel.

For example, FIG. 3 shows the structure of a portion including the fourth rotary valve 45 and the hermetic vessel 46. Since the fourth rotary valve 45 feeds the tobacco material while decreasing its pressure, the direction of rotation of the rotating member 4 with respect to pressure increase- and decrease-side ports 6 and 7 is opposite to that of the first rotary valve 36. Hence, each pocket 5 storing the tobacco material supplied through the supply port 2 transports the tobacco material to the discharge port 3 while sequentially opposing pressure decrease-side ports 7. The pressure inside each pocket 5 is decreased every 5 atm during this transportation.

The carbon dioxide supply and recovery systems of this expanding apparatus will be described. Referring to FIG. 1, reference numeral 61 denotes a gas holder to which carbon dioxide is replenished from a carbon dioxide supply source 62. Carbon dioxide in the gas holder 61 is compressed to a high pressure of, e.g., 30 atm by a compressor 69 and supplied to the impregnating vessel 22 through a dehydrator 60 for removing moisture from carbon dioxide, a heat exchanger 63, and a valve 64. High-pressure carbon dioxide is supplied to the injection ports of the first and second rotary valves 36 and 41 through valves 65 and 66, and injected into the pockets of the rotary valves 36 and 41 to remove the remaining tobacco material.

Carbon dioxide discharged from the final-stage pressure decrease-side port of the second rotary valve 41 is supplied to the preparatory impregnating vessel 21. Carbon dioxide discharged from the final-stage pressure decrease-side port of the third rotary valve 43 is supplied to the hermetic vessel 44. The pressures of the preparatory impregnating vessel 21 and the hermetic vessel 44 are adjusted to, e.g., 15 atm by a pressure control valve 120, and carbon dioxide excessive for maintaining the pressure is pressure-decreased to the atmospheric pressure and recovered.

Low-pressure carbon dioxide finally recovered from these components is recovered in the gas holder 61 and supplied in the following manner. Note that reference numeral 67 denotes a freezer to cool circulating carbon dioxide.

The hermetic vessels 35 and 46 of this expanding apparatus are provided in the upstream of the pressure increase-side first rotary valve 36 and in the downstream of the pressure decrease-side fourth rotary valve 45, respectively, in order to prevent external air from mixing in carbon dioxide which circulates in the manner as described above.

FIG. 2 shows a portion including the pressure increase-side first rotary valve 36 and the hermetic vessel 35. The hermetic vessel 35 is connected to the supply port 2 of the rotary valve 36. The hermetic vessel 35 has a substantially inverted conical shape and serves as a chute. A tobacco material charge port 71 is formed in the upper surface of the hermetic vessel 35, and the tobacco material is continuously charged into the charge port 71 through the rotary valves 33 and 34.

A carbon dioxide bypass port 72 and a carbon dioxide discharge port 73 are formed in the upper surface of the hermetic vessel 35. The bypass port 72 communicates with the final-stage pressure decrease-side port 7 of the rotary valve 36 through the bypass pipe 10*a*. The discharge port 73 communicates with the gas holder 61 through a pipe 74.

In the first rotary valve 36 having the above structure, when each pocket 5 of the rotating member 4 of the rotary valve 36 opposes the final-stage pressure decrease-side port 7, the pressure remaining in the pocket 5 is discharged to the port 7. Since this port 7 communicates with the hermetic vessel 35 through the bypass pipe 10*a* and the bypass port 72, this pressure is discharged into the hermetic vessel 35. Hence, the pressure inside the pocket 5 is set equal to that of the interior of the hermetic vessel 35 so that no remaining pressure will be discharged when this pocket 5 opposes the supply port 2 next time, thereby assuring a smooth flow of the tobacco material.

Every time each pocket 5 opposes the final-stage pressure decrease-side port 7, carbon dioxide is supplied into the hermetic vessel 35 through the bypass pipe 10*a* and the bypass port 72. Air flows into the hermetic vessel 35 together with the charged tobacco material. However, since carbon dioxide is supplied in the hermetic vessel 35, as described above, the interior of the hermetic vessel 35 is set in substantially the carbon dioxide atmosphere. Therefore, air contained in the charged tobacco material is substituted with carbon dioxide, and thereafter the tobacco material is supplied to the preparatory impregnating vessel 21 through the rotary valve 36. As a result, a flow of air into the preparatory impregnating vessel 21 or the like can be prevented.

When each pocket 5 opposes the final-stage pressure decrease-side port 7, the tobacco material remaining in this pocket 5 is supplied to the hermetic vessel 35 together with the injected carbon dioxide, separated from carbon dioxide in the hermetic vessel 35, and supplied to the preparatory impregnating vessel 21, together with the charged tobacco material, through the rotary valve 36. Therefore, the tobacco material will not be wasted, and no member preventing clogging of the filter or the like need be provided.

FIG. 3 shows a portion including the pressure decrease-side fourth rotary valve 45 and the hermetic vessel 46. The hermetic vessel 46 has a substantially inverted conical shape and serves as a chute. A charge port 81 is formed in the upper surface of the hermetic vessel 46 to communicate with the discharge port 3 of the fourth rotary valve 45. A bypass port 82 and a discharge port 83 are formed in the upper portion of the hermetic vessel 46. The bypass port 82 communicates with the final-stage pressure decrease-side port 7 through the bypass pipe 10*b*, and the discharge port 83 communicates with the gas holder 61 through a pipe 84.

The hermetic vessel 46 shown in FIG. 3 prevents air, the water vapor, or the like from flowing into the carbon dioxide circulating system in the same manner as in the hermetic vessel 35 shown in FIG. 2. That is, although the tobacco material charged into the hermetic vessel 46 does not contain air, air or water vapor in the expansion column 51 can flow into the hermetic vessel 46 more or less because of the internal leakage of the air locker valve 47. Even in this case, however, since the gas flowing into the hermetic vessel 46 is substituted with carbon dioxide which is supplied into the hermetic vessel 46, air or the water vapor will not flow to the upstream of the hermetic vessel 46.

The tobacco material expanding apparatus described above has a unit for effectively recovering the expanding agent, i.e., carbon dioxide, and for effectively maintaining the concentration of carbon dioxide in the system. This unit will be described.

As described above, at the portion including the first rotary valve 36 and the hermetic vessel 35 and the portion including the fourth rotary valve 45 and the hermetic vessel 46, carbon dioxide is supplied into the hermetic vessels 35 and 46 to substitute carbon dioxide with air flowing externally. Carbon dioxide discharged from the hermetic vessels 35 and 46 contains air and the like. Therefore, if carbon dioxide recovered from the hermetic vessels 35 and 46 is directly returned to the gas holder 61, air is accumulated in the carbon dioxide circulating system of the expanding apparatus to decrease the efficiency of the apparatus.

In order to prevent such a drawback, carbon dioxide recovered from the hermetic vessels 35 and 46 may be disposed to the outside. However, a large amount of carbon dioxide must be replenished from the carbon dioxide supply source 62, which is disadvantageous in terms of cost. Also, it is not preferable to discharge carbon dioxide to the outer air. This drawback becomes more apparent as the size of the expanding apparatus is increased.

In order to improve the above drawbacks, the expanding apparatus according to the present invention has a recovery/separation unit 91 for efficiently recovering carbon dioxide and separating air mixed in it, thereby efficiently controlling the concentration of carbon dioxide in the system.

Figure 5:
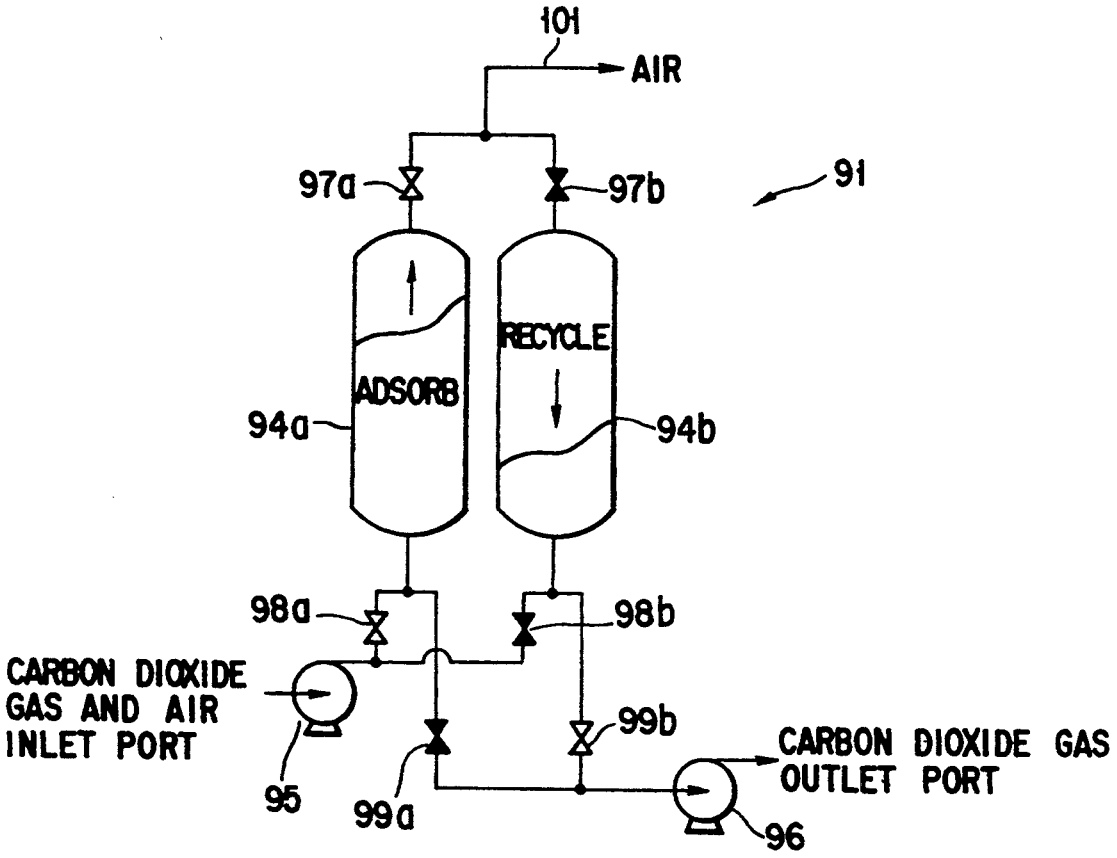
FIG. 5 is a schematic diagram of a recovery/separation unit.
Figure 6:
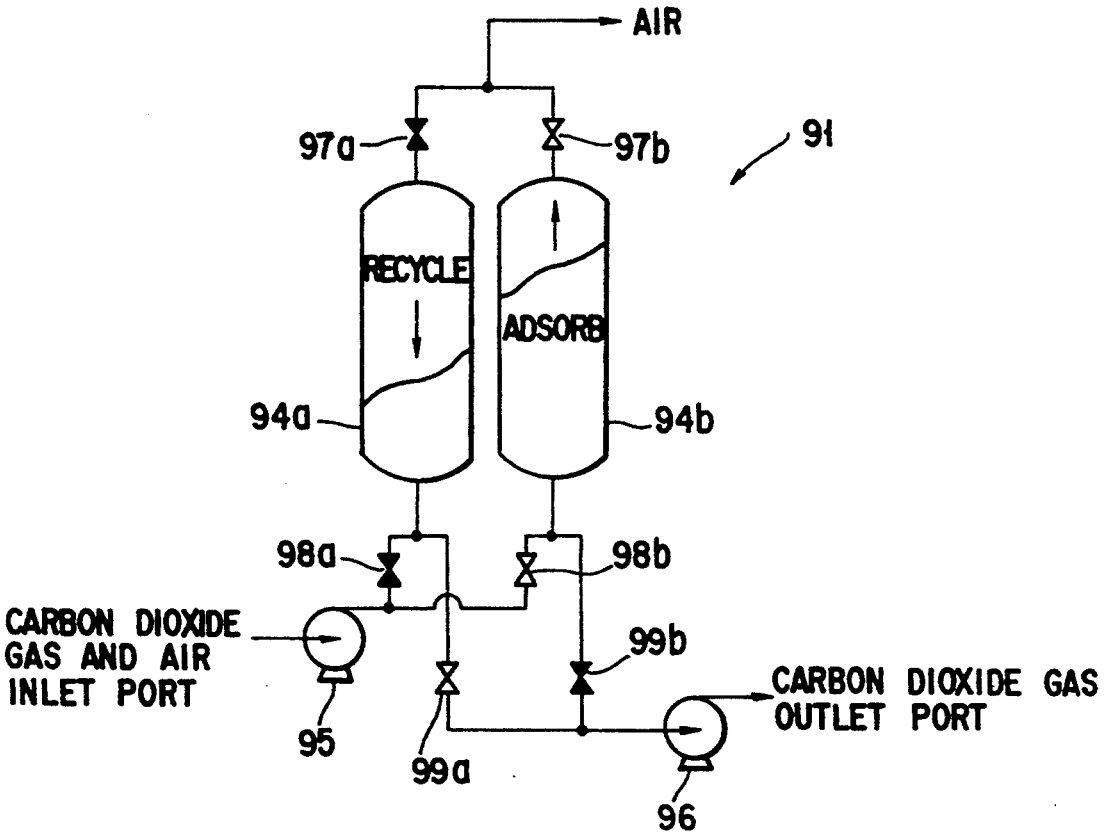
FIG. 6 is a schematic diagram of the recovery/separation unit in another state.

FIGS. 1, 5, and 6 show the recovery/separation unit 91. Selector valves 75 and 85 are provided midway along the pipes 74 and 84 for recovering carbon dioxide discharged from the discharge ports 73 and 83 of the hermetic vessels 35 and 46, respectively, and recovery pipes 92 and 93 branch from the upstreams of the selector valves 75 and 85, respectively. The recovery pipes 92 and 93 communicate with the recovery/separation unit 91. Therefore, when the selector valve 75 or 85 is closed, carbon dioxide containing air which is discharged from the hermetic vessel 35 or 46 is not supplied to the gas holder 61 but supplied to the recovery/separation unit 91.

The recovery/separation unit 91 is an adsorption type carbon dioxide separation unit (PSA described above). More specifically, as shown in FIGS. 5 and 6, a plurality of adsorption towers, e.g., two adsorption towers 94*a* and 94*b* are provided in the recovery/separation unit 91. An adsorbent such as activated charcoal or zeolite is filled in the adsorption towers 94*a* and 94*b*. Each of these adsorbents selectively adsorbs carbon dioxide from a gas mixture containing air and carbon dioxide, and the higher the pressure, the larger the adsorption amount; the lower the pressure, the smaller the adsorption amount.

The recovery/separation unit 91 also has a pressure pump 95 and a vacuum pump 96 each connected to one end portion of each of the adsorption towers 94*a* and 94*b* through valves 98*a* and 98*b*, or valves 99*a* and 99*b*. The other end portion of each of the adsorption towers 94*a* and 94*b* is connected to a discharge pipe 101 through a corresponding one of valves 97*a* and 97*b*.

In the recovery/separation unit 91, as shown in FIG. 5, the valves 98*a* and 97*a* of one adsorption tower 94*a* are opened, and the gas mixture containing carbon dioxide and air which is supplied from the hermetic vessels 35 and 46 is supplied to the adsorption tower 94*a* by the pressure pump 95 so that carbon dioxide is adsorbed by the adsorption tower 94*a*. The remaining gas, e.g., air from which carbon dioxide has been separated, is discharged to the outside through the discharge pipe 101. At this time, the valves 98*b* and 97*b* of the other adsorption tower 94*b* are closed, the valve 99*b* is open, and the interior of the other adsorption tower 94*b* is evacuated to a low pressure by the vacuum pump 96. As a result, carbon dioxide adsorbed in the adsorbent in the other adsorption tower 94*b* is discharged, recovered, and returned to the system of the expanding apparatus described above.

Then, as shown in FIG. 6, the valves 98*a* and 97*a* of one adsorption tower 94*a* are closed and the valves 98*b* and 97*b* of the other adsorption tower 94*b* are opened, in the opposite manner to that described above, to set the interior of one adsorption tower 94*a* at a low pressure, so that carbon dioxide adsorbed in the adsorbent in the adsorption tower 94*a* is discharged and recovered while carbon dioxide is adsorbed in the other adsorption tower 94*b*. This operation is repeated to alternately cause the adsorption towers 94*a* and 94*b* to perform adsorption, thereby separating and recovering carbon dioxide. This cycle is repeated every comparatively short period of, e.g., 90 to 180 sec.

With the recovery/separation unit 91 having the above arrangement, carbon dioxide containing air can be recovered, air is efficiently removed by separation, and only carbon dioxide can be returned to the system of the expanding apparatus. Therefore, carbon dioxide will not be discharged and wasted to the outside, and the concentration of carbon dioxide in the system can be precisely controlled.

Since the recovery/separation unit 91 separates carbon dioxide by adsorption, it can separate even carbon dioxide which has a low concentration. In addition, the recovery/separation unit 91 has a good response characteristic and can stably control the concentration of carbon dioxide in the carbon dioxide circulating system of this expanding apparatus.

Figure 7:
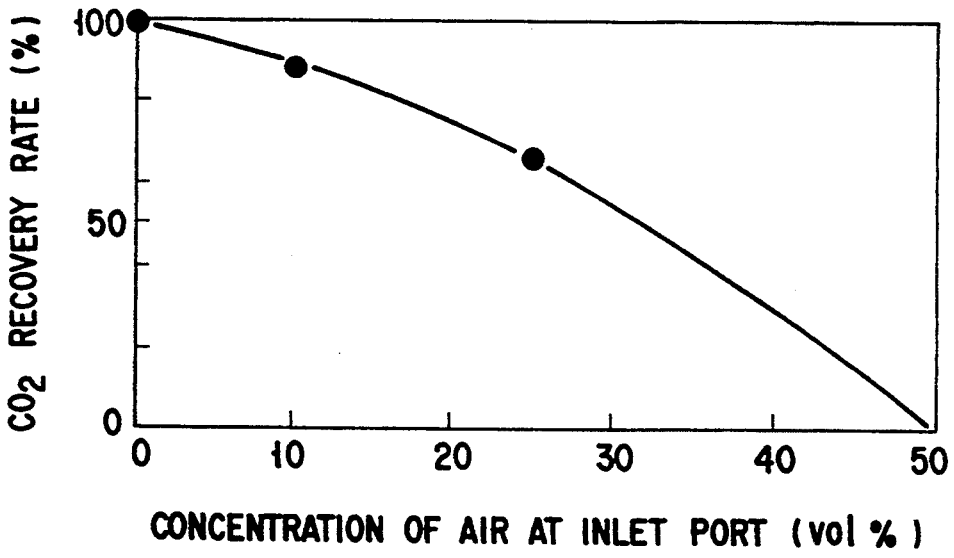
F I G. 7 PRIOR ART
FIG. 7 is a graph showing the characteristics of a liquefaction type separation unit.

More specifically, FIG. 7 shows characteristics of a conventional liquefaction type carbon dioxide separation unit for compressing the gas mixture and separating carbon dioxide by liquefaction. As is apparent from FIG. 7, in the conventional liquefaction type separation unit, when the air concentration of the gas to be processed is high, the carbon dioxide separation efficiency becomes considerably low, and carbon dioxide cannot substantially be separated or recovered. In this liquefaction type separation unit, since starting of the unit and a change in operation require a long time, the unit cannot cope with a change in concentration of carbon dioxide in the carbon dioxide circulating system, and the concentration of carbon dioxide in the system becomes unstable.

Figure 8:
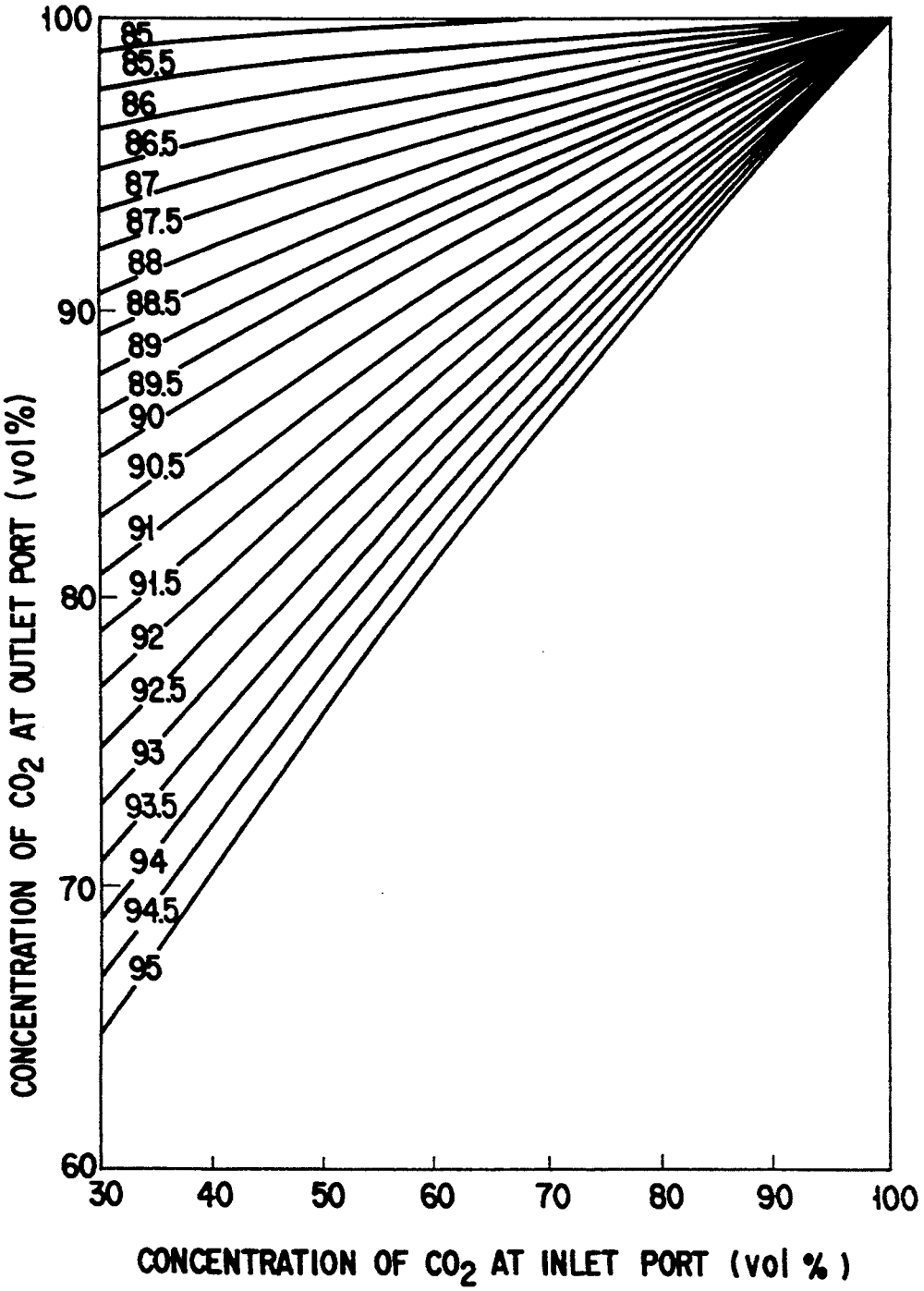
FIG. 8 is a graph showing the characteristics of an adsorption type separation unit.

In contrast to this, the recovery/separation unit 91 described above can maintain a very high separation efficiency, as shown in FIG. 8, even when the concentration of carbon dioxide is low. In addition, since the recovery/separation unit 91 is operated in a very short cycle, as described above, its starting and a change in operation are performed very quickly. As a result, it can readily cope with the change in concentration of carbon dioxide in the carbon dioxide circulating system of this expanding apparatus and can precisely and correctly control the concentration of carbon dioxide in the carbon dioxide circulating system.

Figure 4:
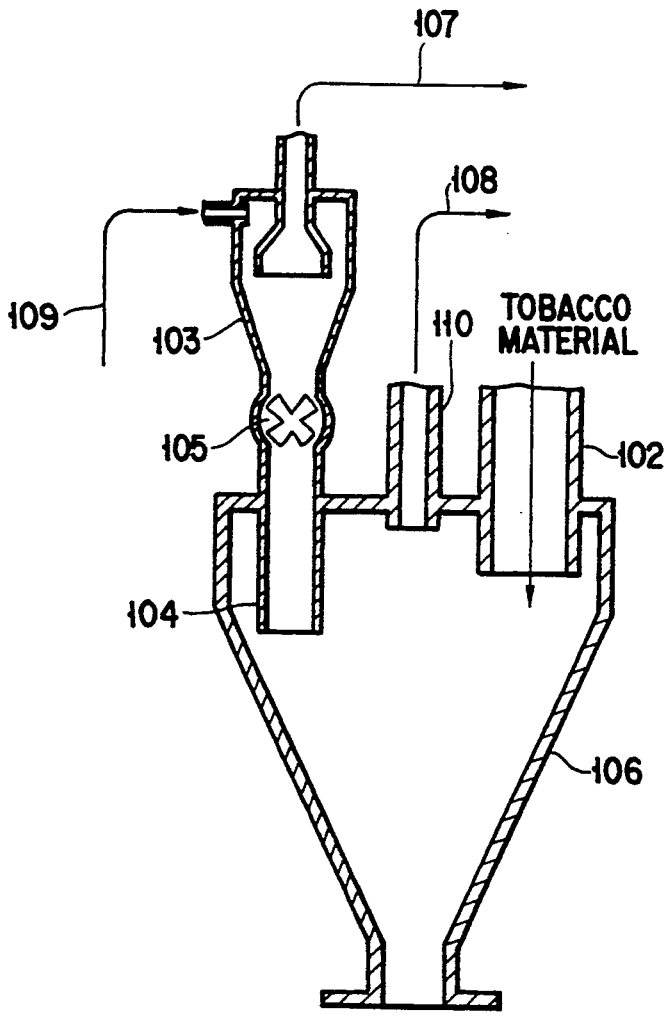
FIG. 4 is a longitudinal sectional view of a modification of a hermetic vessel.

In order to perform separation and recovery of carbon dioxide by the recovery/separation unit 91 more efficiently, the hermetic vessels 35 and 46 can have an arrangement as shown in FIG. 4. The arrangement shown in FIG. 4 has a hermetic vessel 106 similar to that described above, and a charge port 102 is formed in the upper portion of the hermetic vessel 106. A cyclone separator 103 is mounted on the upper portion of the hermetic vessel 106. Carbon dioxide from the final-stage pressure decrease-side port 7 of the rotary valve is supplied to the cyclone separator 103 through a bypass pipe 109, and carbon dioxide and the tobacco material contained in it are separated. Carbon dioxide from which the tobacco material has been separated is recovered in the gas holder 61 through a pipe 107. The separated tobacco material is supplied to the hermetic vessel 106, together with a small amount of carbon dioxide, from a supply port 104 through a rotary valve 105. This tobacco material is supplied to the downstream side together with the tobacco material which is charged from the charge port 102. Air which externally flows into the hermetic vessel 106 is substituted with carbon dioxide supplied to the hermetic vessel 106. Carbon dioxide mixed with this air is supplied to the recovery/separation unit 91 described above from a recovery port 110 through a recovery pipe 108.

when this hermetic vessel is used, most of carbon dioxide supplied from the rotary valve is directly recovered in the gas holder 61, and the amount of carbon dioxide mixed with air and supplied to the recovery/-separation unit 91 is decreased. Accordingly, the load on the recovery/separation unit 91 is decreased. In this case, although the concentration of carbon dioxide of the gas mixture supplied to the recovery/separation unit 91 is decreased, since the adsorption type recovery/separation unit 91 can efficiently separate even carbon dioxide having a low concentration, as described above, no inconvenience is caused.

The air concentration of the expanding agent in the system is preferably minimum, and the air concentration must be controlled to be, e.g., about 5 volume % or less. In order to control the air concentration, the air concentration of the expanding agent supplied to the impregnating vessel 22 is measured by an air concentration detector 100, the amount of recovered gas supplied to the recovery/separation unit 91 is changed by automatically adjusting the valve opening degrees of the flow control valves 75 and 85 connected to the recovery pipes 74 and 84 extending from the hermetic vessels 35 and 46, respectively, so that the measured value satisfies a preset air concentration, thereby controlling the air concentration.

If the detected value does not satisfy the preset air concentration even when all the recovered gas from the hermetic vessels 35 and 46 are supplied to the recovery/separation unit 91, part or all of the recovered gas from the preparatory impregnating vessel 21 and the hermetic vessel 44 may also be supplied to the recovery/separation unit 91.

Figure 9:
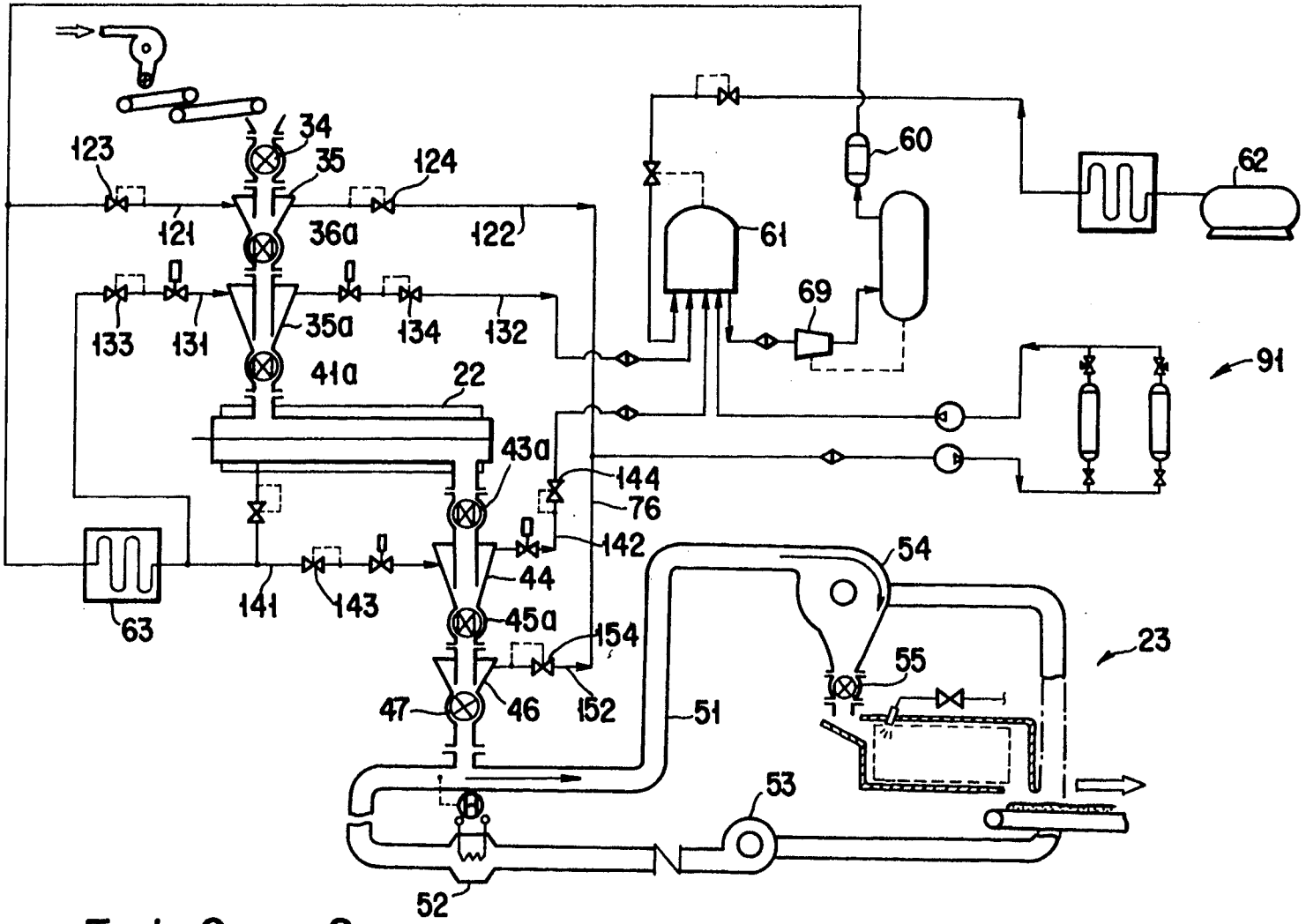
FIG. 9 is a schematic diagram showing an overall arrangement of an expanding apparatus according to the second embodiment of the present invention.

In the first embodiment described above, a rotary valve is used as a valve unit, for continuously feeding the tobacco material while increasing or decreasing the pressure. However, a ball valve can be used in place of the rotary valve. FIG. 9 shows an expanding apparatus according to the second embodiment of the present invention which uses ball valves. In the second embodiment, a preparatory impregnating vessel is omitted, and only an impregnating vessel 22 is provided. Excluding this, the second embodiment has the same arrangement as the first embodiment described above. In FIG. 9, portions corresponding to those in the first embodiment are denoted by the same reference numerals, and a detailed description thereof will be omitted.

Referring to FIG. 9, reference numerals 36*a*, 41*a*, 43*a*, and 45*a* denote first, second, third, and fourth ball valves, respectively, and 35, 35*a*, 44, and 46 denote hermetic vessels. The respective ball valves feed the tobacco material by rotating ball members, and no pressure increase- or decrease-side port arranged in the rotary valve described above is formed in any of them. Therefore, carbon dioxide is supplied to the hermetic vessels 35, 35*a*, and 44 through pipes 121, 131, and 141, and valves 123, 133, and 143 to maintain their interiors in the carbon dioxide atmosphere.

Carbon dioxide is supplied to the harmetic vessel 46 together with tobacco material through the forth ball valve 45*a* to maintain its interior in the carbon dioxide atmosphere.

Since air is not mixed in carbon dioxide discharged from the hermetic vessels 35*a* and 44, this carbon dioxide is directly recovered in a gas holder 61 through pipes 132 and 142 and valves 134 and 144. Since air is mixed in carbon dioxide discharged from the most-upstream hermetic vessel 35 and the most-downstream hermetic vessel 46, carbon dioxide from them is supplied to a recovery/separation unit 91 identical to that described above through pipes 122 and 152 and valves 124 and 154.

Figure 10:
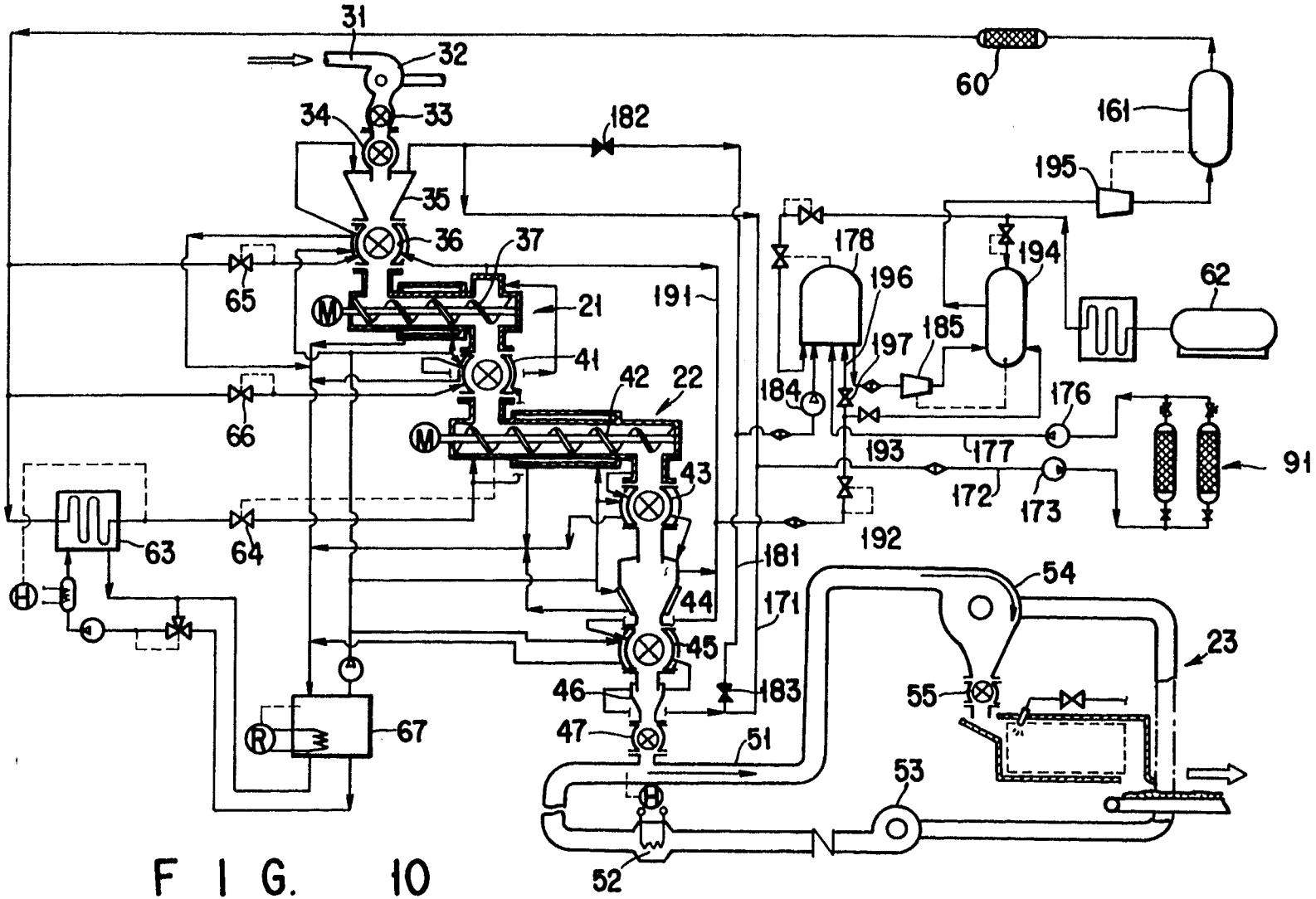
FIG. 10 is a schematic diagram showing an overall arrangement of an expanding apparatus according to the third embodiment of the present invention.

Also, energy is needed to compress carbon dioxide recovered in the above manner to a high pressure.In order to minimize the energy needed for compressing the recovered carbon dioxide, the carbon dioxide recovery system may be arranged as in the third embodiment shown in FIG. 10. The recovery system according to the third embodiment recovers carbon dioxide by separating it into low- and intermediate-pressure systems. A tobacco material expanding apparatus according to the third embodiment is identical to that of the first embodiment described above, and a detailed description thereof will be omitted.

The carbon dioxide supply and recovery systems of the third embodiment will be described. Carbon dioxide recovered from the supply and discharge systems described above is finally pressure-increased to a pressure slightly higher than the impregnating pressure of about 30 atm and supplied to a high-pressure tank 161. Carbon dioxide in the high-pressure tank 161 is supplied to an impregnating vessel 22 identical to that described above through a heat exchanger 63 and a valve 64. This high-pressure carbon dioxide is also supplied to the injection ports of first and second rotary valves 36 and 41 through valves 65 and 66, respectively, and injected into the pockets of the rotary valves 36 and 41 to remove the remaining tobacco material.

Carbon dioxide discharged from the final-stage pressure decrease-side port of the second rotary valve 41 is supplied to the preparatory impregnating vessel 21, carbon dioxide discharged from the final-stage pressure decrease-side port of a third rotary valve 43 is supplied to a hermetic vessel 44, the interiors of the preparatory impregnating vessel 21 and the hermetic vessel 44 are adjusted to, e.g., 15 atm by a pressure adjustment valve 193, and carbon dioxide excessive for maintaining the pressure is recovered.

Carbon dioxide recovered from the tobacco material supply and discharge systems described above is separately recovered by the low- and intermediate-pressure recovery systems and finally recovered in the high-pressure tank described above.

The structure of the low-pressure recovery system will be described. The interior of a hermetic vessel 35 at the terminal of the supply system described above is maintained at a low pressure of, e.g., substantially the atmospheric pressure, and carbon dioxide recovered from the hermetic vessel 35 is at a low pressure. Air contained in the transported tobacco material is present in the hermetic vessel 35. The interior of the hermetic vessel 46 at the terminal of the tobacco material discharge system is also maintained at a low pressure of substantially the atmospheric pressure, and carbon dioxide recovered from the hermetic vessel 46 is at a low pressure. Carbon dioxide recovered from the hermetic vessel 46 contains air or moisture flowing from the outside.

Low-pressure carbon dioxide recovered from the hermetic vessels 35 and 46 is collected in a low-pressure recovery pipe 171. Carbon dioxide collected in the low-pressure recovery pipe 171 is supplied to a separation unit 91 identical to that described above by a pump 173 through a low-pressure separation pipe 172.

Carbon dioxide from which air is separated by the separation unit 91 is supplied to a low-pressure tank 178 by a pump 176 through low-pressure return pipe 177. The low-pressure tank 178 is kept at a low pressure and stores carbon dioxide.

A low-pressure bypass pipe 181 is provided independently of the low-pressure recovery pipe 171. The low-pressure bypass pipe 181 is connected to the low-pressure recovery pipe 171 through valves 182 and 183 and to the low-pressure tank 178 through a pump 184. Accordingly, the low-pressure carbon dioxide recovered by opening the valves 182 and 183 is supplied to the low-pressure tank 178 by bypassing through the separation unit 91 described above.

Carbon dioxide recovered in the low-pressure tank 178 is pressure-increased by an intermediate-pressure booster 185 from the low pressure to an intermediate pressure of about 5 to 15 atm and supplied to an intermediate-pressure tank 194 of an intermediate-pressure recovery system to be described later. Carbon dioxide is replenished from a carbon dioxide supply source 62 to the low-pressure tank 178 to replenish carbon dioxide in the carbon dioxide circulating system of the expanding apparatus.

The intermediate-pressure recovery system mentioned above will be described. The interiors of the preparatory impregnating vessel 22 and the hermetic vessel 44 are maintained at an intermediate pressure of about 15 atm by the pressure adjustment valve 193, and carbon dioxide recovered from the preparatory impregnating vessel 21 and the hermetic vessel 44 is at the intermediate pressure. Carbon dioxide recovered from the preparatory impregnating vessel 21 and the hermetic vessel 44 contain air. Carbon dioxide recovered from the preparatory impregnating vessel 21 and the hermetic vessel 44 is collected to an intermediate-pressure recovery pipe 191 and supplied to the intermediate-pressure tank 194 through intermediate-pressure pipes 192 and 193. The intermediate-pressure tank 194 stores carbon dioxide at an intermediate pressure of about 5 to 15 atm.

An intermediate-pressure bypass pipe 196 branches midway along each of the intermediate-pressure pipes 192 and 193 and is connected to the low-pressure tank 178. A valve 197 is connected midway along each intermediate-pressure bypass pipe 196. Thus, when the valves 197 are opened, all or part of the intermediate-pressure carbon dioxide is not supplied to the intermediate-pressure tank 194 but is supplied to the low-pressure tank 178 as well.

In the third embodiment, since intermediate-pressure carbon dioxide is recovered by the intermediate-pressure recovery system, a high-pressure booster 195 of the intermediate-pressure recovery system only need to increase the pressure of carbon dioxide from the intermediate pressure to the high pressure, so that the capacity and power consumption of the booster 195 can be small. In this embodiment, since the low-pressure carbon dioxide recovered by the low-pressure recovery system is pressure-increased to the intermediate pressure and supplied to the intermediate-pressure tank 194, the intermediate-pressure tank 194 serves as the buffer tank of the two boosters, thus facilitating the operation management of these boosters.

In this embodiment, since only low-pressure carbon dioxide in which air is mixed is supplied to the separation unit 91 to separate mixed air or the like, the capacity of the separation unit 91 can be small.

Figure 11:
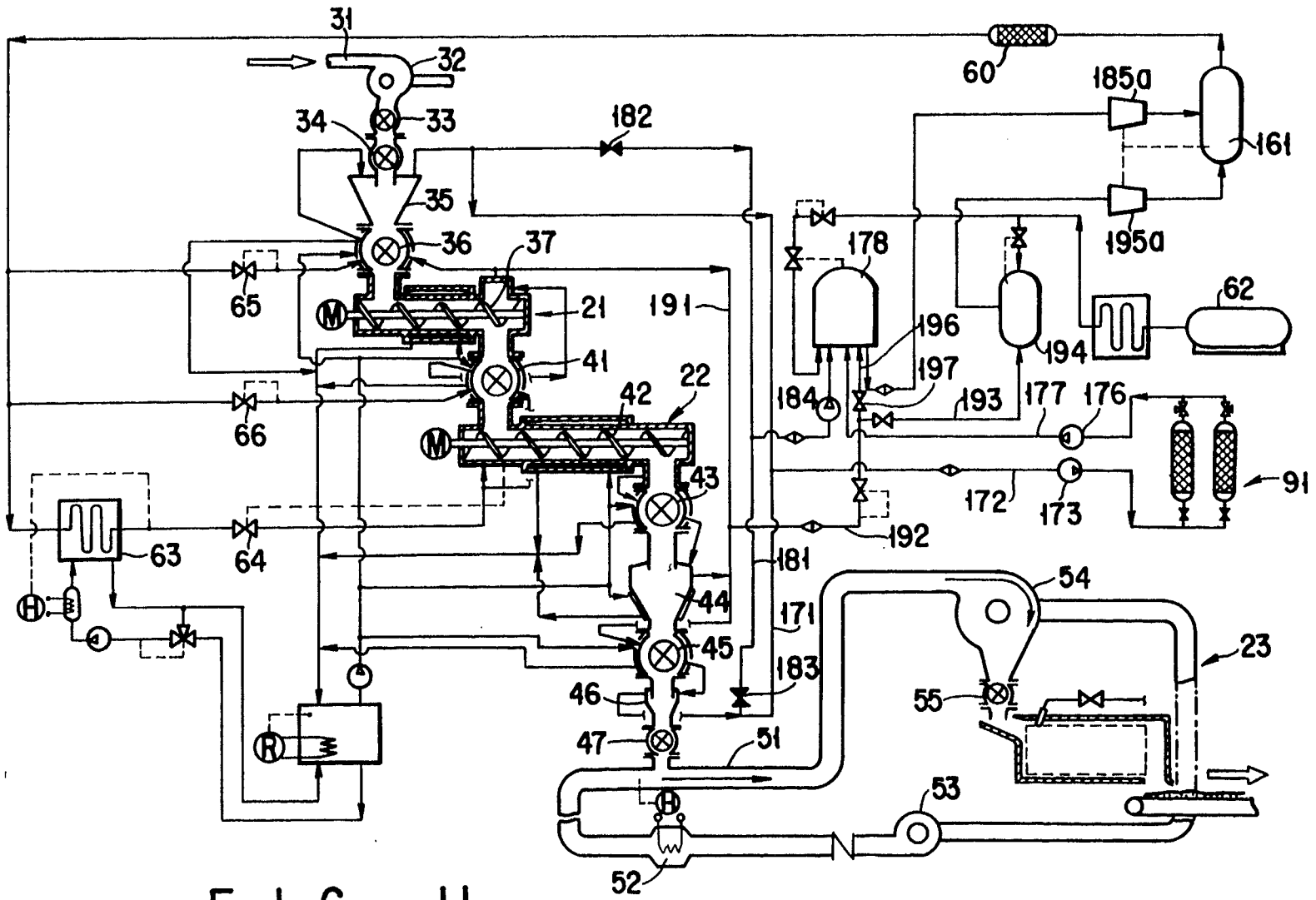
FIG. 11 is a schematic diagram showing an overall arrangement of an expanding apparatus according to the fourth embodiment of the present invention.

The apparatus having two carbon dioxide recovery systems is not limited to the third embodiment described above. For example, FIG. 11 shows the fourth embodiment of the present invention. The expanding apparatus according to the fourth embodiment has a first high-pressure booster **185*a* for quickly increasing the pressure of recovered carbon dioxide recovered in a low-pressure tank 178 from the low pressure to the high pressure. Carbon dioxide in the low-pressure tank 178 is directly supplied to a high-pressure tank 161, and carbon dioxide in an intermediate-pressure tank 194 is pressure-increased by a second high-pressure booster 195*a*, which increases the pressure from the intermediate pressure to the high pressure in the same manner as in the third embodiment, and supplied to the high-pressure tank 161. Excluding these points, the fourth embodiment has the same arrangement to that of the third embodiment described above. In FIG. 11**, portions corresponding to those in the third embodiments are denoted by the same reference numerals, and a detailed description thereof will be omitted.

In the fourth embodiment, since the first and second high-pressure boosters **185*a* and 195*a* are arranged in parallel with each other, they can be operated independently, thus facilitating operation management of the boosters 185*a* and 195*a***.

Additional advantages and modifications will readily occur to those skilled in the art. Therefore, the invention in its broader aspects is not limited to the specific details, and representative devices, and shown and described herein. Accordingly, various modifications may be made without departing from the spirit or scope of the general inventive concept as defined by the appended claims and their equivalents.

What is claimed is:

1. An expanding apparatus for impregnating an agricultural product material such as a tobacco material with carbon dioxide as an expanding agent, and thereafter expanding said carbon dioxide impregnated in the material by heating, thereby expanding the material, the material being continuously supplied and expanded, comprising:

an impregnating vessel to which said carbon dioxide is supplied to maintain an impregnating pressure and the material to be expanded is continuously supplied;

supply-side valve means for continuously supplying the material to said impregnating vessel and supplying said carbon dioxide to said impregnating vessel while increasing a pressure of said carbon dioxide around the material;

discharge-side valve means for continuously discharging the material from said impregnating vessel and discharging said carbon dioxide from said impregnating vessel while decreasing the pressure of said carbon dioxide around the material;

carbon dioxide recovering/separating means comprising a low-pressure recovery system for recovering said carbon dioxide at a low pressure in a low-pressure tank, an intermediate-pressure recovery system for recovering said carbon dioxide at an intermediate pressure in an intermediate-pressure tank, and booster means for pressure-increasing said carbon-dioxide recovered in said low- and intermediate-pressure tanks to a high pressure and supplying said carbon-dioxide to a high-pressure tank; and hermetic vessels arranged respectively at an upstream side of said supply-side valve means and at a downstream side of said discharge-side valve means, the supply-side valve means and the discharge-side valve means being connected to the respective hermetic vessels by both a port and a bypass pipe, low-pressure carbon dioxide being supplied to said hermetic vessels by at least said bypass pipe connected thereto, the material being supplied to or exhausted from said impregnating vessel passing through said ports and said hermetic vessels and being freshened with carbon dioxide contained in said hermetic vessels when passing therethrough, supply of low-pressure carbon dioxide to the hermetic vessels by the bypass pipes preventing air from entering said impregnating vessel.

2. The apparatus according to claim 1, wherein said booster means comprises an intermediate-pressure booster for pressure-increasing said carbon dioxide having a low pressure in said low-pressure tank to an intermediate pressure and supplying said intermediate-pressure carbon dioxide to said intermediate-pressure tank, and a high-pressure booster for pressure-increasing said carbon dioxide having the intermediate pressure in said intermediate-pressure tank to a high pressure and supplying said high-pressure carbon dioxide to said high-pressure tank.

3. The apparatus according to claim 1, wherein said booster means comprises a first high-pressure booster for pressure-increasing said carbon dioxide having a low pressure in said low-pressure tank to a high pressure and supplying said high-pressure carbon dioxide to said high-pressure tank, and a second high-pressure booster for pressure-increasing said carbon dioxide having the intermediate pressure in said intermediate-pressure tank to a high pressure and supplying said high-pressure carbon dioxide to said high-pressure tank.

* * * * *